US005732618A

United States Patent [19]

Buehl

[11] Patent Number: 5,732,618

[45] Date of Patent: Mar. 31, 1998

[54] APPARATUS FOR SEPARATING LIQUID FROM A MATERIAL

[75] Inventor: Karl-Heinz Buehl, Aachen, Germany

[73] Assignee: Filterwerk Mann & Hummel GmbH, Ludwigsburg, Germany

[21] Appl. No.: 629,043

[22] Filed: Apr. 8, 1996

[30] Foreign Application Priority Data

Apr. 8, 1995 [DE] Germany ..... 195 13 438.9

[51] Int. Cl.[6] ..... B30B 9/14

[52] U.S. Cl. ..... 100/45; 100/96; 100/112; 100/117; 100/127; 100/145

[58] Field of Search ..... 100/45, 49, 96, 100/97, 112, 117, 127, 145, 147

[56] References Cited

U.S. PATENT DOCUMENTS

| | | | |
|---|---|---|---|
| 120,400 | 10/1871 | Schoenstein et al. | 100/96 |
| 332,718 | 12/1885 | Lafferty . | |
| 604,348 | 5/1898 | Bussells | 100/117 |
| 641,266 | 1/1900 | Bussells | 00/117 |
| 643,891 | 2/1900 | Bussells | 100/117 |
| 837,010 | 12/1906 | Vernsten . | |
| 1,112,119 | 9/1914 | Colburn | 100/127 |
| 3,590,730 | 7/1971 | Heinrich . | |
| 4,121,967 | 10/1978 | Reinhall . | |
| 4,384,955 | 5/1983 | Nakakura . | |
| 4,397,230 | 8/1983 | Hunt et al. | 100/45 |
| 4,582,568 | 4/1986 | Iyengar | 100/117 |
| 4,781,823 | 11/1988 | Shinozaki | 100/117 |
| 5,391,069 | 2/1995 | Bendzick . | |
| 5,411,669 | 5/1995 | Narath | 100/45 |

FOREIGN PATENT DOCUMENTS

| | | | |
|---|---|---|---|
| 103788 | 7/1926 | Australia | 100/147 |
| 182387 | 6/1955 | Austria . | |
| 565714 | 10/1993 | European Pat. Off. . | |
| 2258800 | 8/1975 | France . | |
| 101024 | 1/1899 | Germany . | |
| 273782 | 5/1914 | Germany . | |
| 2736810 | 3/1978 | Germany . | |
| 4117543 | 12/1992 | Germany . | |
| 460302 | 11/1950 | Italy | 100/96 |
| 484311 | 11/1954 | Italy . | |
| 100860 | 2/1941 | Sweden | 100/117 |
| 508183 | 7/1971 | Switzerland . | |
| 1578126 | 11/1980 | United Kingdom . | |
| 2159428 | 12/1985 | United Kingdom . | |

*Primary Examiner*—Stephen F. Gerrity
*Attorney, Agent, or Firm*—Evenson, McKeown, Edwards & Lenahan P.L.L.C.

[57] ABSTRACT

A system for separating liquid from material, particularly from metal chips, which comprises a housing with a material inlet opening, a material discharge opening, a spiral-shaped pressure member disposed in the housing, and a plurality of openings in the housing for removing extracted liquid.

10 Claims, 3 Drawing Sheets

APPARATUS FOR SEPARATING LIQUID FROM A MATERIAL

BACKGROUND OF THE INVENTION

The present invention relates to a system or apparatus for separating liquids from a material such as metal chips, comprising a housing with inlet and discharge openings for the material.

Filter presses are known, for example, in the form of plate filter presses. The material to be pressed is placed between filter plates, and liquid present in or on the material is removed under high pressure. This discontinuous process is very laborious. Furthermore, after each operating cycle the filter cake must be removed, the apparatus cleaned, and fresh material introduced.

Other apparatus are known, especially systems for the thermal drying of material. A disadvantage of these apparatus is their relatively high energy consumption

SUMMARY OF THE INVENTION

It is the object of the invention to provide an apparatus for separating liquid from a material.

Another object of the invention is to provide an apparatus which is particularly suitable for separating oil from oily metal chips.

A further object of the invention is to provide an apparatus of the foregoing general type which is simple in construction and yet permits continuous operation.

These and other objects are achieved in accordance with the present invention by providing an apparatus for separating a liquid from a solid material, said apparatus comprising a housing with a material inlet opening and a material discharge opening, and a rotatable, spiral-shaped pressure member arranged in the housing for conveying the material through the housing from the inlet opening to the discharge opening; the housing having a bottom wall with a plurality of liquid outlet openings formed therein through which liquid separated from the material can drain away.

An important advantage of the invention is that a compact apparatus is created, which operates continuously, and which makes it possible, in particular, to separate oil from metal chips either as such or as an emulsion or to separate water.

The invention operates on the principle of an extruder, and is capable of separating liquids from very large amounts of material in a short time.

In accordance with one advantageous embodiment of the invention, the housing and the spiral-shaped pressure member are of cylindrical shape. This has the advantage of especially easy manufacture.

In accordance with an alternate embodiment, the housing and the spiral-shaped pressure member are constructed with a conical configuration. This embodiment has the advantage that any wear on the housing or on the pressure member can be compensated by an axial shifting of the pressure member.

In accordance with a further preferred embodiment of the invention, optimum compression of the material is achieved by constructing the pressure member with a tapered core having its greatest diameter at the discharge end of the apparatus and its smallest diameter at the end adjacent the inlet opening. This arrangement facilitates a very high compression of the material.

For simple separation of the liquid, the housing or the strainer is advantageously provided with a perforated bottom. Such a perforated bottom is stable under pressure and can easily be cleaned.

In another variant embodiment of the spiral press, the pressure member has a variable pitch. Advantageously, the pitch of the spiral will decrease toward the discharge opening. This measure also facilitates greater compression of the material as it passes through the apparatus during processing.

It is furthermore possible within the scope of the invention to make the size of the discharge opening variable. This variability is advantageous especially when different materials are to be treated, i.e., materials having different anti-friction properties.

In an advantageous embodiment of the invention, a hopper is provided above the extruder to supply the material to be treated. In this hopper there is disposed a cylinder which carries breaker rods. The breaker rods serve to break up the material, which sometimes enters the hopper in the form of a filter cake, so as to facilitate better feeding to the extruder. Advantageously, the hopper is provided with lattice bars which further improve the break-up of the material.

In another preferred embodiment of the invention, a funnel is provided for collecting liquid exiting from the perforated bottom of the housing. The liquid can be conveyed out of the funnel, preferably by means of an ejector. A flushing or rinsing system also may be provided. The flushing system and the ejector can each be operated using same liquid which adheres to the material, i.e. typically oil.

These and other features of preferred embodiments of the invention, in addition to being set forth in the claims, are also disclosed in the specification and/or the drawings, and the individual features each may be implemented in embodiments of the invention either individually or in the form of subcombinations of two or more features and can be applied to other fields of use and may constitute advantageous, separately protectable constructions for which protection is also claimed.

BRIEF DESCRIPTION OF THE DRAWINGS

The invention will be described hereinafter in further detail with reference to illustrative preferred embodiments shown in the accompanying drawings in which.

DETAILED DESCRIPTION OF PREFERRED EMBODIMENTS

Figure 1:
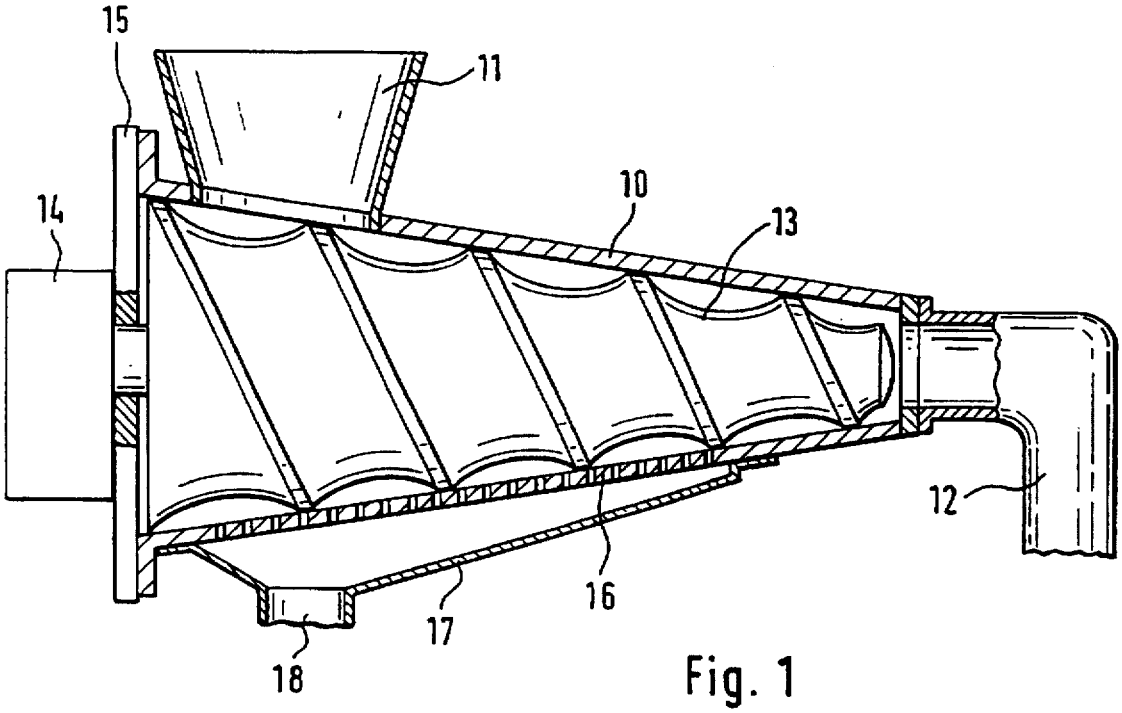
FIG. 1 is a sectional view of an apparatus for separating liquid from material comprising a conically shaped pressure member.

The apparatus for separating liquid from material according to FIG. 1 comprises a housing 10 which has a tapered configuration, and which is provided with an inlet opening 11 and a discharge opening 12. In the housing is a spiral pressure member in the form of a screw conveyor or auger 13. Pressure member 13 is driven in rotation by a drive unit 14. The drive unit 14 is fastened on the housing via a flange disk or plate 15. In the lower part of the housing 10 there are a plurality of openings in the form of a sieve bottom 16. Under sieve bottom 16 there is a collecting trough or funnel 17 with an outlet 18 for collecting liquid exiting from the housing through the sieve openings.

The material from which adhering liquid is to be separated is introduced through the opening 11 and is transported and simultaneously squeezed by the tapered shape of the pressure member 13. This compression brings about a separation of the liquid from the material. The separated liquid is carried away through the sieve bottom 16.

The apparatus of the invention is especially suitable for processing a material from which liquid is to be separated such as metal chips which are produced by machining and which contain a high content of liquid, especially a lubricant emulsion.

Both the housing 10 and the pressure member 13 are formed of a wear-resistant material or they are provided with a wear-resistant surface. If nevertheless a certain amount of wear should occur over the course of time, this wear can be compensated by adjusting the position of the pressure member, i.e., by shifting the pressure member axially.

Figure 2:
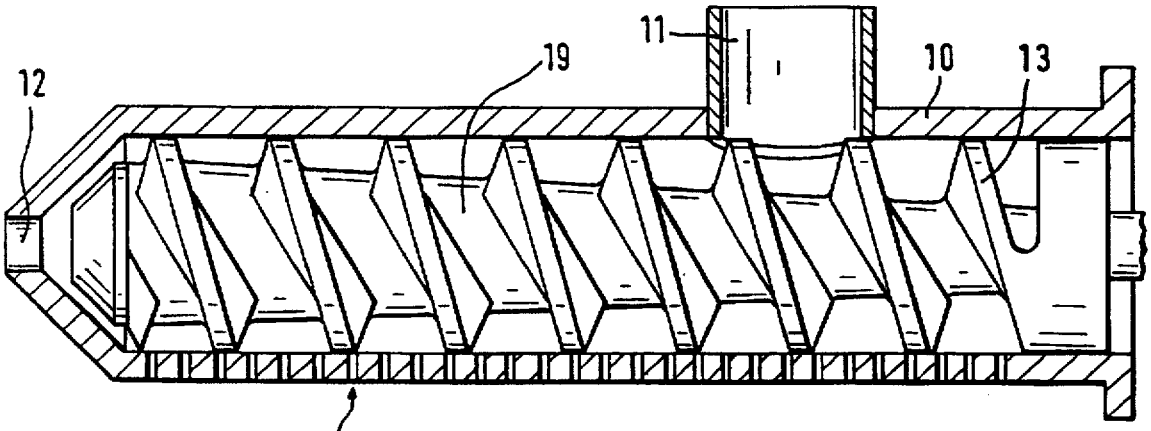
FIG. 2 is a sectional view of an apparatus for separating liquid from material comprising a cylindrically shaped pressure member.

A variant of the system or apparatus for separating liquid from material is shown in FIG. 2. In this embodiment the pressure member 13 is a cylindrical element, and the housing 10 likewise has a cylindrical form.

The compression of the material is accomplished due to the tapered shape of the core 19 of the pressure member 13. Here again the housing 10 is provided with a sieve bottom through which the liquid can drain. The material from which liquid is to be separated passes through the inlet opening 11 into the press chamber, and the treated material from which liquid has been separated is discharged through the material discharge opening 12.

It will be apparent that the size of the discharge opening 12 also has an influence on the separating action. The result of a very small outlet opening will be that a high pressure will develop in the front portion of the pressure member, thereby increasing the degree of liquid separation. The size of this outlet opening can be varied by suitable means, such as choke valves or the like.

Figure 3:
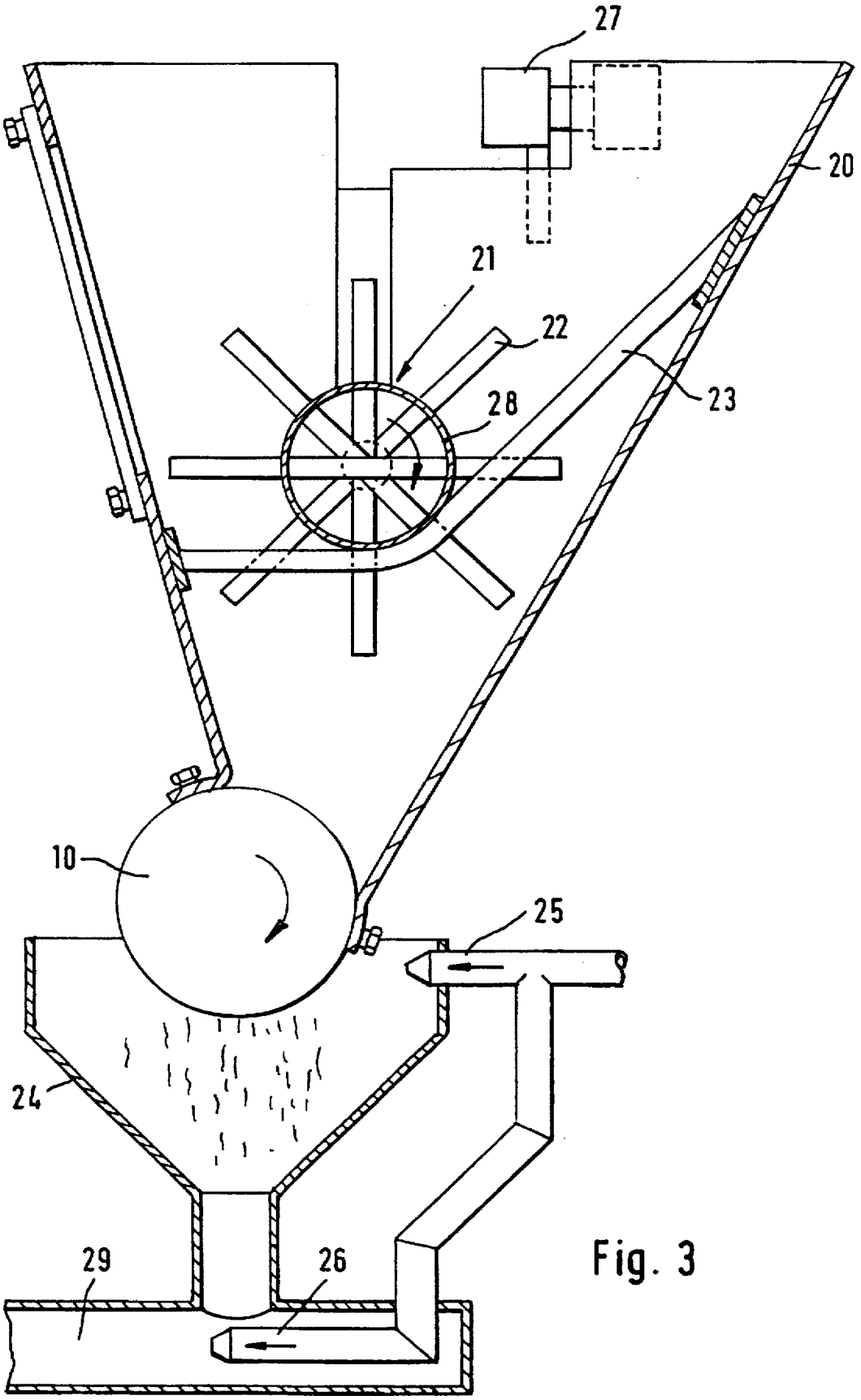
FIG. 3 is a view of a system including a hopper.

FIG. 3 shows an apparatus for separating a liquid from a material in accordance with FIG. 1 with the housing 10. A hopper 20 is arranged above the housing 10. This hopper 20 is offset laterally from the axial center of the housing 10. This has the advantage that the introduced material is more readily captured by the screw conveyor.

Figure 4:
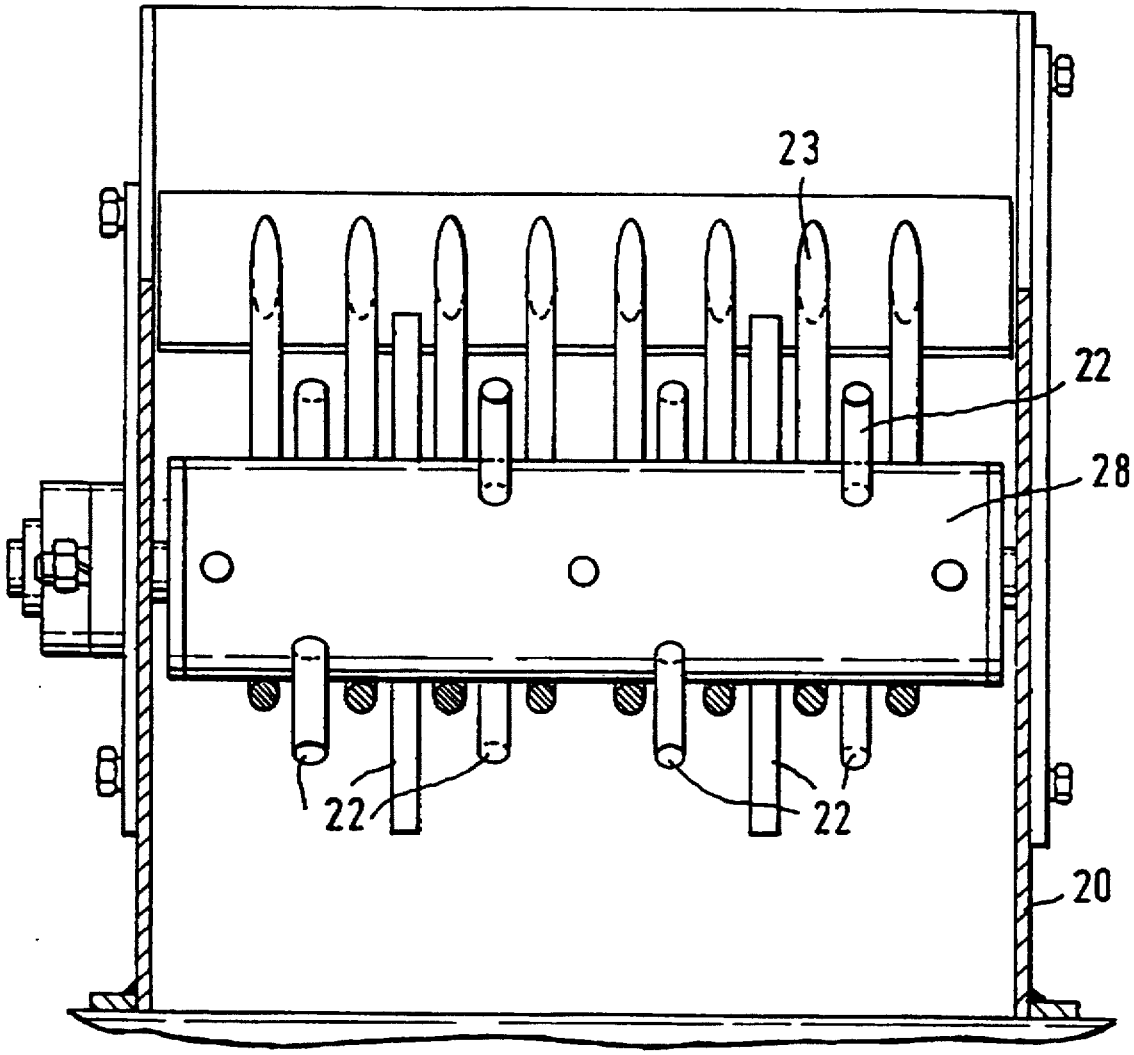
FIG. 4 is a top view of tie hopper of FIG. 3.

The introduced material which is to be processed in order to separate liquid therefrom may be, for example, a filter cake consisting of metal chips. To prevent this filter cake from clogging the hopper 20, a breaking system 21 is provided. This breaking system comprises, as also shown in FIG. 4, a rotating cylinder 28 on which driving bars 22 are arranged. Underneath the cylinder are lattice bars 23, which are affixed to the hopper 20. Thus, when the cylinder 28 rotates, the driving bars 22 extend between the lattice bars 23 so that reliable transport of the material is assured.

The plan view in FIG. 4 shows that the individual driving bars 22 are disposed at different points on the cylinder 28 and extend between a pair of the lattice bars 23. A fill level sensor 27 is arranged in upper part of the hopper 20 and signals any overfill.

Underneath the press is a collecting funnel 24 for the exiting liquid. This liquid, for example oil, is contaminated to some extent, so that there is a danger that deposits or incrustations may form on the funnel 24. To prevent such incrustation, a rinsing or flushing system 25 is provided. This flushing system forces oil against the inner wall of the funnel 24 and removes any deposits of dirt. The liquid is carried off through the pipe 29 by means of an ejector 26. This ejector 26 is also powered with oil. This means that the removed liquid can be made available directly to the process, i.e., a coolant emulsion apparatus.

The foregoing description and examples have been set forth merely to illustrate the invention and are not intended to be limiting. Since modifications of the described embodiments incorporating the spirit and substance of the invention may occur to persons skilled in the art, the invention should be construed broadly to include all variations falling within the scope of the appended claims and equivalents thereof.

What is claimed is:

1. An apparatus for separating a liquid from a solid material, said apparatus comprising a housing with a material inlet opening and a material discharge opening, and a rotatable, spiral shaped pressure member arranged in the housing for conveying the material through the housing from the inlet opening to the discharge opening, said housing having a bottom wall with a plurality of liquid outlet openings formed therein through which liquid separated from the material can drain away, a collecting funnel arranged underneath the outlet openings for liquid extracted from said material, a flushing system associated with said collecting funnel, and a fluid ejector for removing liquid from the collecting funnel.

2. An apparatus according to claim 1, wherein said housing bottom wall comprises a sieve.

3. An apparatus according to claim 1, wherein said material comprises oily metal chips.

4. An apparatus according to claim 1, wherein the housing and the spiral-shaped pressure member are cylindrical.

5. An apparatus according to claim 1, wherein the housing and the spiral-shaped pressure member are conical.

6. An apparatus according to claim 1, wherein the pressure member has a conical core.

7. An apparatus according to claim 1, wherein the spiral-shaped pressure member has a pitch which decreases toward the material discharge opening.

8. An apparatus according to claim 1, further comprising a hopper for said material arranged to discharge into the inlet opening, and a transport roll arranged inside the hopper and provided with driving bars for the material.

9. An apparatus according to claim 8, further comprising lattice bars in said hopper arranged such that said driving bars extend between said lattice bars.

10. An apparatus according to claim 8, further comprising a fill level sensor associated with said hopper for determining how much material is in the hopper.

* * * * *